US006979211B1

(12) United States Patent
Shen

(10) Patent No.: US 6,979,211 B1
(45) Date of Patent: Dec. 27, 2005

(54) EXPANSION DEVICE WITH A MASKING BRACKET FOR A CARD BUS CONNECTOR

(75) Inventor: Ying-Chih Shen, Ta-Li (TW)

(73) Assignee: Universal Scientific Industrial Co., Ltd., Nan-Tou Hsien ( * ) Notice: Subject to any disclaimer, the term of this patent is extended or adjusted under 35 U.S.C. 154(b) by 0 days.

(21) Appl. No.: 11/121,599

(22) Filed: May 4, 2005

(51) Int. Cl.[7] ..... H01R 13/44
(52) U.S. Cl. ..... 439/135; 439/940
(58) Field of Search ..... 439/135, 633, 439/630, 940

(56) References Cited

U.S. PATENT DOCUMENTS 4,795,354 A * 1/1989 Owen ..... 439/137
5,026,295 A * 6/1991 Fong et al. ..... 439/135
5,106,313 A * 4/1992 Lwee et al. ..... 439/135
6,135,795 A * 10/2000 Ho et al. ..... 439/135
6,168,444 B1 * 1/2001 Wu et al. ..... 439/135
6,837,722 B2 * 1/2005 Sakamoto ..... 439/135

* cited by examiner

*Primary Examiner*—Phuong Dinh
(74) *Attorney, Agent, or Firm*—Allston L. Jones

(57) ABSTRACT

An expansion device includes a card bus connector and a masking bracket. The card bus connector includes a connector housing that has a card slot defined by opposite long lateral walls and opposite short lateral walls. The masking bracket includes a frame plate for abutting against an outer wall surface of one of the long lateral walls, an anchoring plate that extends from a lateral edge of the frame plate for abutting against an outer wall surface of one of the short lateral walls, and a masking plate that extends a top edge of the frame plate toward the other one of the long lateral walls so as to shield a predetermined portion of the card slot. The masking plate has a bottom side formed with a rib projection that extends into the card slot when the masking bracket engages the card bus connector.

8 Claims, 5 Drawing Sheets

EXPANSION DEVICE WITH A MASKING BRACKET FOR A CARD BUS CONNECTOR

BACKGROUND OF THE INVENTION

1. Field of the Invention

The invention relates to an expansion device, more particularly to an expansion device with a masking bracket for a card bus connector.

2. Description of the Related Art

Referring to FIG. 1, a computer motherboard 1 is provided with a plurality of card bus connectors 11 (such as PCI bus) that permit connection to interface cards 2 (only one is shown) for data transmission purposes.

In view of the modular trend in the design of the card bus connectors 11, interface cards 2 having different specifications may be applied to the same card bus connector 11, even if the interface cards 2 have different allocations of contacts 21, as long as the contact specifications of the interface cards 2 are supported by the card bus connector 11.

However, there always exists a compatibility problem between an interface card 2 and the computer motherboard 1, which is determined by chip sets mounted on the motherboard 1. Nevertheless, users are usually unaware of compatibility problems, and often insert an interface card 2 not supported by the motherboard 1 into a compatible card bus connector 11 such that the motherboard 1 ceases to function properly.

SUMMARY OF THE INVENTION

Therefore, the object of the present invention is to provide an expansion device with a masking bracket for a card bus connector so as to overcome the above drawback associated with the prior art.

According to the present invention, an expansion device comprises a card bus connector and a masking bracket. The card bus connector is adapted for mounting on a circuit board, and includes a connector housing that has a pair of opposite long lateral walls and a pair of opposite short lateral walls interconnecting the long lateral walls and cooperating with the long lateral walls to define a card slot. The masking bracket engages removably the card bus connector, and has a frame portion and a masking portion connected to the frame portion. The frame portion includes a frame plate for abutting against an outer wall surface of one of the long lateral walls. The frame plate has a pair of opposite lateral edges, and a top edge extending between the lateral edges. The frame portion further includes an anchoring plate that extends from one of the lateral edges of the frame plate for abutting against an outer wall surface of one of the short lateral walls. The masking portion includes a masking plate that extends in a transverse direction from the top edge of the frame plate toward the other one of the long lateral walls so as to shield a predetermined portion of the card slot of the card bus connector. The masking plate has a top side, and a bottom side opposite to the top side and formed with a rib projection that extends into the card slot when the masking bracket engages the card bus connector.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
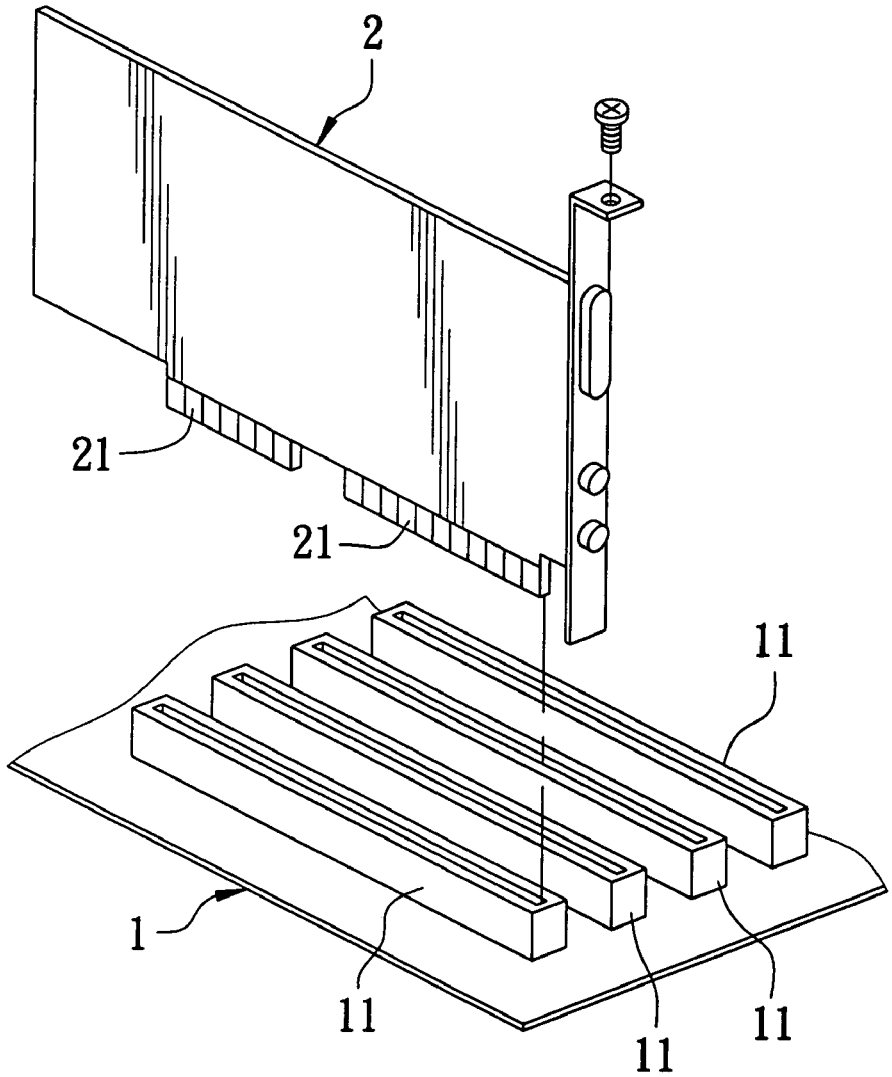
FIG. 1 PRIOR ART
FIG. 1 is a fragmentary exploded perspective view to illustrate connection between a computer motherboard and an interface card.
Figure 2:
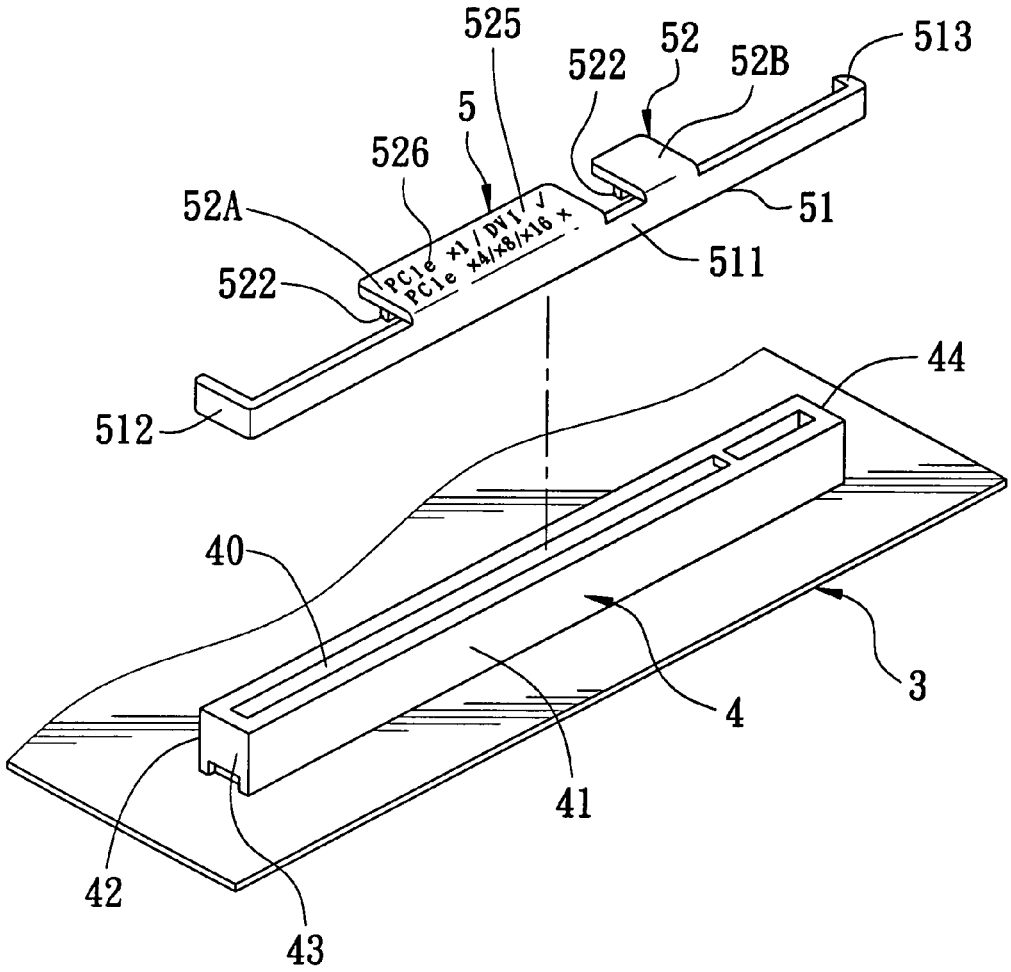
FIG. 2 is an exploded perspective view of the first preferred embodiment of an expansion device according to this invention.

Referring to FIG. 2, the first preferred embodiment of an expansion device according to this invention is shown to be adapted for use with a circuit board, such as a computer motherboard 3, and includes a card bus connector 4 and a masking bracket 5.

The card bus connector 4 is adapted for mounting on the motherboard 3 in a conventional manner, and includes a connector housing that has a pair of opposite long lateral walls 41, 42 and a pair of opposite short lateral walls 43, 44 interconnecting the long lateral walls 41, 42 and cooperating with the long lateral walls 41, 42 to define a card slot 40.

The masking bracket 5 engages removably the card bus connector 4, and has a frame portion 51 and a masking portion 52 connected to the frame portion 51.

Figure 3:
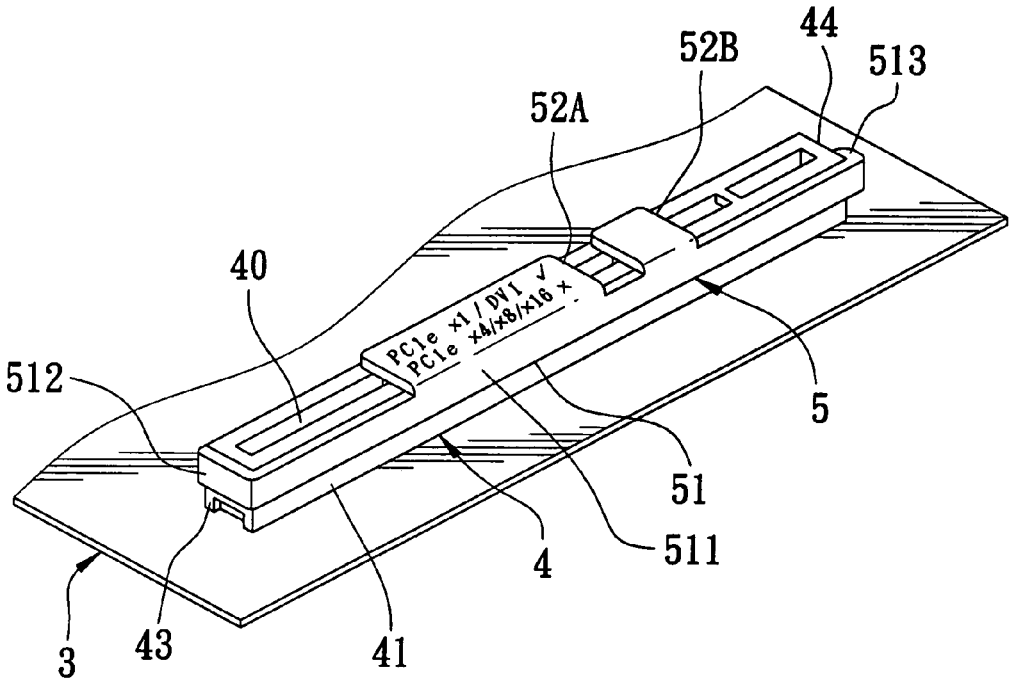
FIG. 3 is an assembled perspective view of the first preferred embodiment.

With further reference to FIG. 3, the frame portion 51 includes an elongate frame plate 511 for abutting against an outer wall surface of the long lateral wall 41. The frame plate 511 has a pair of opposite lateral edges, and a top edge extending between the lateral edges. The frame portion 51 further includes a first anchoring plate 512 that extends from one of the lateral edges of the frame plate 511 for abutting against an outer wall surface of the short lateral wall 43. In this embodiment, the frame portion 51 further includes a second anchoring plate 513 that extends from the other one of the lateral edges of the frame plate 511 for abutting against an outer wall surface of the short lateral wall 44.

In this embodiment, the masking portion 52 includes first and second masking plates 52A, 52B that extend in a transverse direction from the top edge of the frame plate 511 toward the long lateral wall 42. The lengths of the masking plates 52A, 52B, as well as their positions on the frame plate 511, are chosen according to contact specifications of predetermined interface cards (not shown) supported by the motherboard 3 and compatible with the expansion device of this invention. Hence, predetermined portions of the card slot 40 of the card bus connector 4 are shielded accordingly (see FIG. 3) to prevent insertion of non-compatible interface cards that are not supported by the motherboard 3 into the card slot 40, i.e., only those interface cards (not shown) that are supported by the motherboard 3 and that are compatible with the expansion device of this invention can be inserted into the card slot 40. Each of the masking plates 52A, 52B has a top side 525, and a bottom side 521 (see FIG. 4) opposite to the top side 525 and formed with a rib projection 522 that extends into the card slot 40 for clamping by contacts in the card slot 40 when the masking bracket 5 engages the card bus connector 4. In this embodiment, the first masking plate 52A is longer than the second masking plate 52B, and the top side 525 of the first masking plate 52A is formed with device specification information 526, such as by printing, engraving, embossing, etc., for indicating the types of interface cards (not shown) supported by the motherboard 3 and compatible with the expansion device of this invention.

Figure 4:
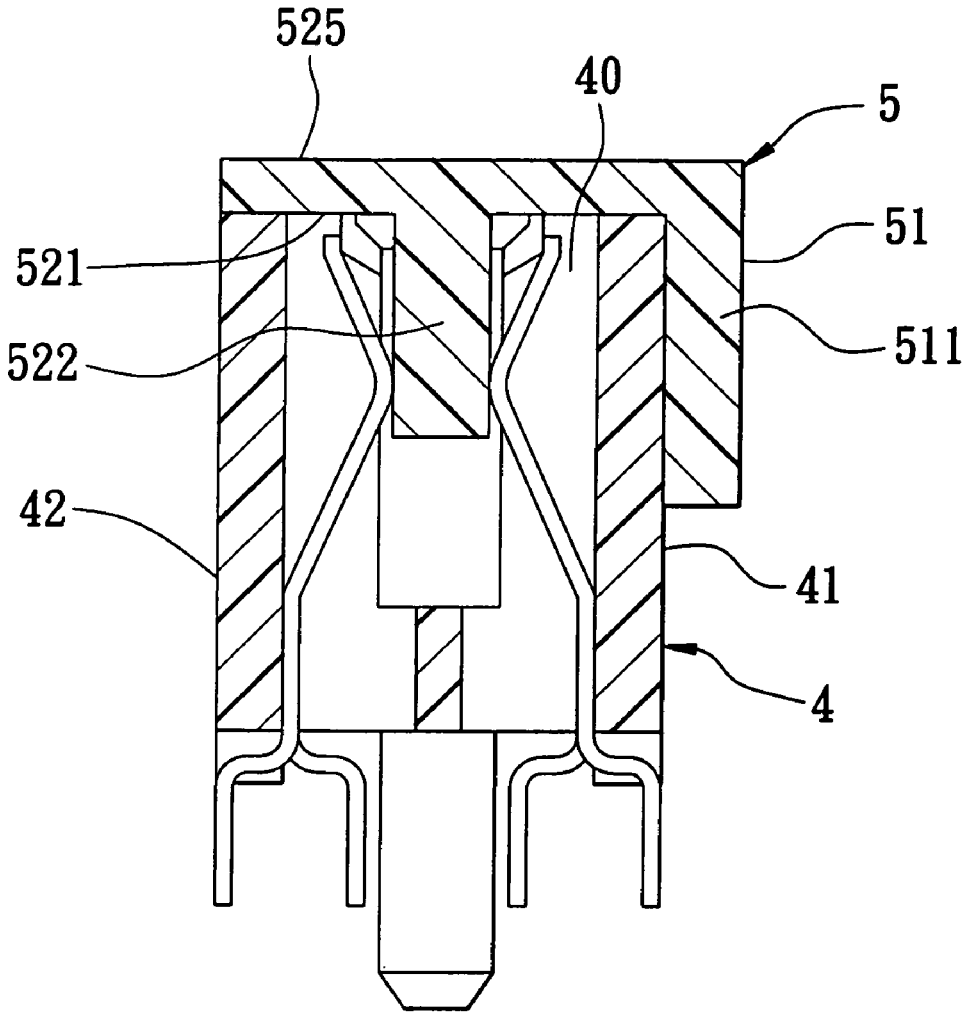
FIG. 4 is a schematic sectional view to illustrate an assembled state of the first preferred embodiment.

As shown in FIGS. 3 and 4, when the masking bracket 5 engages the card bus connector 4, the frame plate 511 and the first and second anchoring plates 512, 513 cooperate to embrace the long lateral wall 41 and the short lateral walls 43, 44 of the connector housing of the card bus connector 4, and the masking plates 52A, 52B extend from the top edge of the frame plate 511 toward the long lateral wall 42 so as to shield the predetermined portions of the card slot 40. The rib projections 522 on the masking plates 52A, 52B extend into the card slot 40 so as to anchor removably the masking bracket 5 on the card bus connector 4.

It is apparent from the foregoing that different configurations of masking brackets 5 may be fabricated to define different specifications of compatible interface cards.

Figure 5:
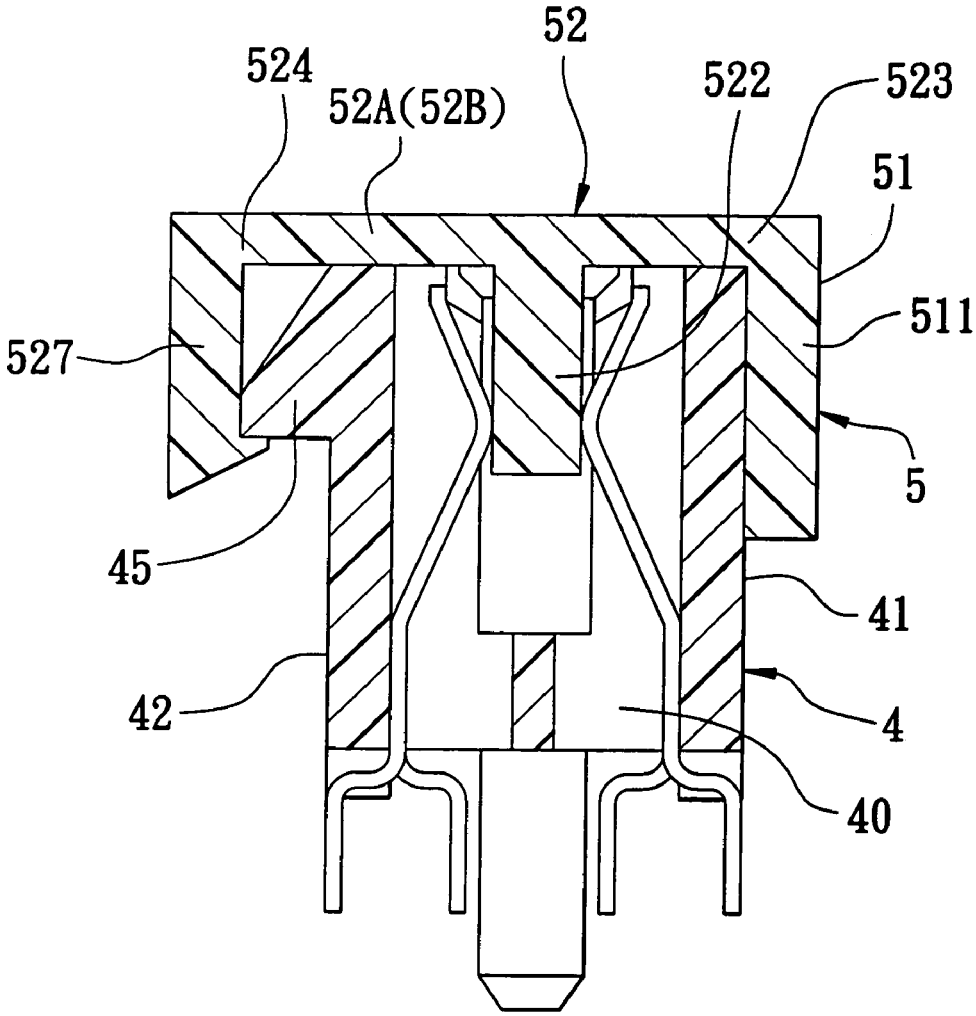
FIG. 5 is a schematic sectional view to illustrate an assembled state of the second preferred embodiment of an expansion device according to this invention.

FIG. 5 illustrates the second preferred embodiment of an expansion device according to this invention, which is a modification of the previous embodiment. Each masking plate 52A(52B) of this embodiment has a connecting end 523 connected to the top edge of the frame plate 511, and a free end 524 opposite to the connecting end 523. The long lateral wall 42 has an upper portion formed with an outwardly protruding anchor projection 45. The masking portion 52 further includes hook projections 527 (only one is shown) connected respectively to the free ends 524 of the masking plates 52A(52B) for engaging removably the anchor projection 45.

The engagement between the hook and anchor projections 527, 45 enhances stability of engagement between the masking bracket 5 and the card bus connector 4. Hence, the masking bracket 5 can be prevented from being removed undesirably from the card bus connector 4 when an interface card (not shown) is removed from the card slot 40.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An expansion device for a circuit board, comprising:

a card bus connector adapted for mounting on the circuit board, said card bus connector including a connector housing that has a pair of opposite long lateral walls and a pair of opposite short lateral walls interconnecting said long lateral walls and cooperating with said long lateral walls to define a card slot; and a masking bracket engaging removably said card bus connector, said masking bracket having a frame portion and a masking portion connected to said frame portion, said frame portion including a frame plate for abutting against an outer wall surface of one of said long lateral walls, said frame plate having a pair of opposite lateral edges and a top edge extending between said lateral edges, said frame portion further including a first anchoring plate that extends from one of said lateral edges of said frame plate for abutting against an outer wall surface of one of said short lateral walls, said masking portion including a masking plate that extends in a transverse direction from said top edge of said frame plate toward the other one of said long lateral walls so as to shield a predetermined portion of said card slot of said card bus connector, said masking plate having a top side and a bottom side opposite to said top side and formed with a rib projection that extends into said card slot when said masking bracket engages said card bus connector.

2. The expansion device as claimed in claim 1, wherein said frame portion further includes a second anchoring plate that extends from the other one of said lateral edges of said frame plate for abutting against an outer wall surface of the other one of said short lateral walls.

3. The expansion device as claimed in claim 1, wherein:

said masking plate has a connecting end connected to said top edge of said frame plate, and a free end opposite to said connecting end;

the other one of said long lateral walls having an upper portion formed with an outwardly protruding anchor projection;

said masking portion further including a hook projection connected to said free end of said masking plate for engaging removably said anchor projection.

4. The expansion device as claimed in claim 1, wherein said top side of said masking plate has device specification information formed thereon.

5. A masking bracket adapted for engaging removably a card bus connector, the card bus connector including a connector housing that has a pair of opposite long lateral walls and a pair of opposite short lateral walls interconnecting the long lateral walls and cooperating with the long lateral walls to define a card slot, said masking bracket comprising a frame portion and a masking portion connected to said frame portion, said frame portion including a frame plate adapted for abutting against an outer wall surface of one of the long lateral walls, said frame plate having a pair of opposite lateral edges and a top edge extending between said lateral edges, said frame portion further including a first anchoring plate that extends from one of said lateral edges of said frame plate and adapted for abutting against an outer wall surface of one of the short lateral walls, said masking portion including a masking plate that extends in a transverse direction from said top edge of said frame plate toward the other one of the long lateral walls so as to be adapted to shield a predetermined portion of the card slot of the card bus connector, said masking plate having a top side and a bottom side opposite to said top side and formed with a rib projection that is adapted to extend into the card slot when said masking bracket engages the card bus connector.

6. The masking bracket as claimed in claim 5, wherein said frame portion further includes a second anchoring plate that extends from the other one of said lateral edges of said frame plate and that is adapted for abutting against an outer wall surface of the other one of the short lateral walls.

7. The masking bracket as claimed in claim 5, the other one of the long lateral walls of the connector housing of the card bus connector having an upper portion formed with an outwardly protruding anchor projection, wherein:

said masking plate has a connecting end connected to said top edge of said frame plate, and a free end opposite to said connecting end;

said masking portion further including a hook projection connected to said free end of said masking plate and adapted for engaging removably the anchor projection.

8. The masking bracket as claimed in claim 5, wherein said top side of said masking plate has device specification information formed thereon.

* * * * *